US005499846A

United States Patent [19]

Phillip

[11] Patent Number: 5,499,846

[45] Date of Patent: Mar. 19, 1996

[54] PERIODICAL HARDCOVER

[76] Inventor: Jason L. Phillip, P.O. Box 641428, San Francisco, Calif. 94164-1428

[21] Appl. No.: 371,767

[22] Filed: Jan. 12, 1995

[51] Int. Cl.[6] ..... B42D 3/00

[52] U.S. Cl. ..... 281/29; 281/31; 281/19.1; 281/15.1; 281/34

[58] Field of Search ..... 281/18, 19.1, 34, 281/29, 31, 34, 51, 15.1; 402/4

[56] References Cited

U.S. PATENT DOCUMENTS 4,497,508 2/1985 McHugh ..... 281/34
4,893,979 1/1990 Alpers ..... 281/34 X
5,004,514 4/1991 Pugliese et al. ..... 281/29 X
5,087,078 2/1992 Phillips ..... 281/36 X

*Primary Examiner*—Willmon Fridie, Jr.

[57] ABSTRACT

A hardcover for reinforcing the binding end cover of a periodical. The inventive device includes a front cover envelope for receiving the front cover of the periodical, and a rear cover envelope for receiving the rear cover of the periodical. The front and rear cover envelopes include overlapping binding panels which can be adhesively secured to the binding of the periodical.

4 Claims, 4 Drawing Sheets

PERIODICAL HARDCOVER

BACKGROUND OF THE INVENTION

1. Field of the Invention

The present invention relates to binding devices and more particularly pertains to a periodical hardcover for reinforcing the binding and cover of a periodical.

2. Description of the Prior Art

The use of binding devices is known in the prior art. More specifically, binding devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art binding devices include U.S. Pat. Nos. 5,178,414; 4,893,837; 4,886,299; 4,846,500; 4,527,814; and 4,497,508.

While these devices fulfill their respective, particular objectives and requirements, the aforementioned patents do not disclose a periodical hardcover for reinforcing the binding and cover of a periodical which includes a front cover envelope for receiving the front cover of the periodical, and a rear cover envelope for receiving the rear cover of the periodical, wherein the front and rear cover envelopes include overlapping binding panels which can be adhesively secured to the binding of the periodical.

In these respects, the periodical hardcover according to the present invention substantially departs from the conventional concepts and designs of the prior art, and in so doing provides an apparatus primarily developed for the purpose of reinforcing the binding and cover of a periodical.

SUMMARY OF THE INVENTION

In view of the foregoing disadvantages inherent in the known types of binding devices now present in the prior art, the present invention provides a new periodical hardcover construction wherein the same can be utilized for reinforcing the binding and cover of a periodical. As such, the general purpose of the present invention, which will be described subsequently in greater detail, is to provide a new periodical hardcover apparatus and method which has many of the advantages of the binding devices mentioned heretofore and many novel features that result in a periodical hardcover which is not anticipated, rendered obvious, suggested, or even implied by any of the prior art binding devices, either alone or in any combination thereof.

To attain this, the present invention generally comprises a hardcover for reinforcing the binding end cover of a periodical. The inventive device includes a front cover envelope for receiving the front cover of the periodical, and a rear cover envelope for receiving the rear cover of the periodical. The front and rear cover envelopes include overlapping binding panels which can be adhesively secured to the binding of the periodical.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new periodical hardcover apparatus and method which has many of the advantages of the binding devices mentioned heretofore and many novel features that result in a periodical hardcover which is not anticipated, rendered obvious, suggested, or even implied by any of the prior art binding devices, either alone or in any combination thereof.

It is another object of the present invention to provide a new periodical hardcover which may be easily and efficiently manufactured and marketed.

It is a further object of the present invention to provide a new periodical hardcover which is of a durable and reliable construction.

An even further object of the present invention is to provide a new periodical hardcover which is susceptible of a low cost of manufacture with regard to both materials and labor, and which accordingly is then susceptible of low prices of sale to the consuming public, thereby making such periodical hardcovers economically available to the buying public.

Still yet another object of the present invention is to provide a new periodical hardcover which provides in the apparatuses and methods of the prior art some of the advantages thereof, while simultaneously overcoming some of the disadvantages normally associated therewith.

Still another object of the present invention is to provide a new periodical hardcover for reinforcing the binding and cover of a periodical.

Yet another object of the present invention is to provide a new periodical hardcover which includes a front cover envelope for receiving the front cover of the periodical, and a rear cover envelope for receiving the rear cover of the periodical.

Even still another object of the present invention is to provide a new periodical hardcover wherein the front and rear cover envelopes include overlapping binding panels which can be adhesively secured to the binding of the periodical.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
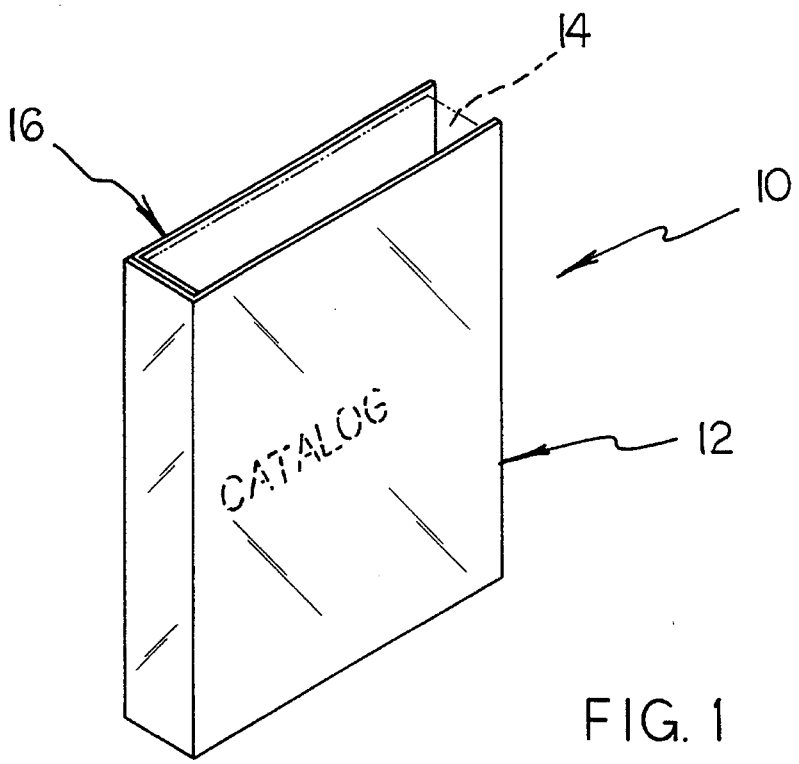
FIG. 1 is an isometric illustration of a periodical hardcover according to the present invention in use.

With reference now to the drawings, and in particular to FIGS. 1–8 thereof, a new periodical hardcover embodying the principles and concepts of the present invention and generally designated by the reference numeral 10 will be described.

More specifically, it will be noted that the periodical hardcover 10 comprises a front cover means 12 for receiving and enclosing a front cover of a catalog 14 so as to permit viewing of the front cover from an exterior of the periodical hardcover 10, as shown in FIG. 1. A rear cover means 16 is provided for use with the present invention 10 for receiving and enclosing a rear cover of the catalog 14 so as to permit viewing of the rear cover from an exterior of the hardcover 10 in a manner similar to that of the front cover means 12. By this structure, the cover of the catalog 14 is reinforced and protected from damage by the periodical hardcover 10.

Figure 2:
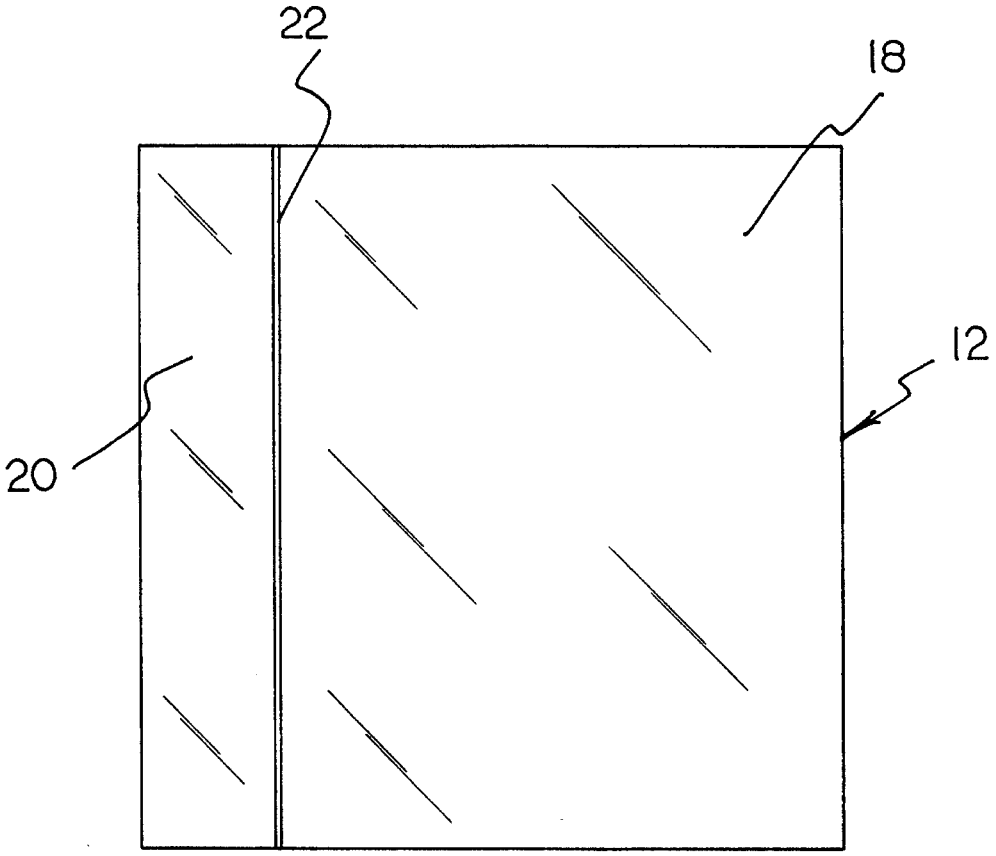
FIG. 2 is a front elevation view of a front cover means of the present invention.
Figure 3:
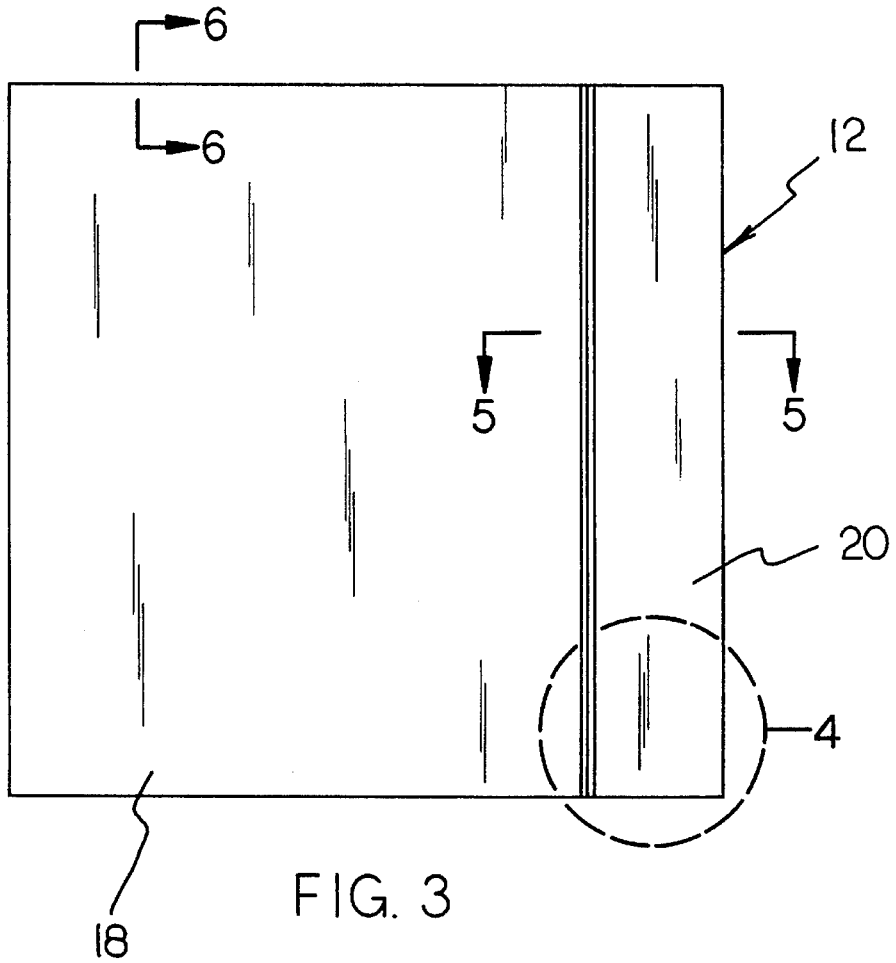
FIG. 3 is a rear elevation view of the front cover means.
Figure 4:
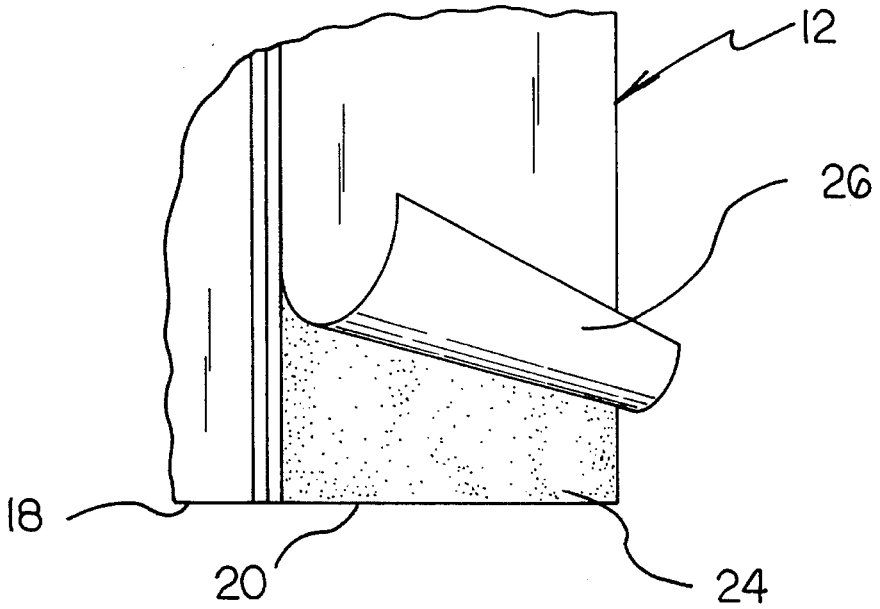
FIG. 4 is an enlarged rear elevation view of the area set forth in FIG. 3.

As best illustrated in FIGS. 1 and 2, it can be shown that the front cover means 12 is substantially similar in design and configuration to the rear cover means 16 and comprises a cover envelope 18 within which the respective cover of the catalog 14 can be received. A binding panel 20 is coupled to an edge of the cover envelope 18 by a fold line 22. Preferably, the binding panel 20 is integrally coupled to the cover envelope 18, with the fold line 22 permitting pivoting of the binding panel 20 relative to the cover envelope 18. As shown in FIG. 4, an interior surface of the binding panel 20 is preferably coated with an adhesive 24 which can be utilized to secure the interior surface of the binding panel to the unlabeled binding of the catalog 14, or alternatively, to another binding panel of another cover means 12 or 16. Preferably, a removable backing 26 is secured to the adhesive 24 prior to use of device 10.

Figure 5:
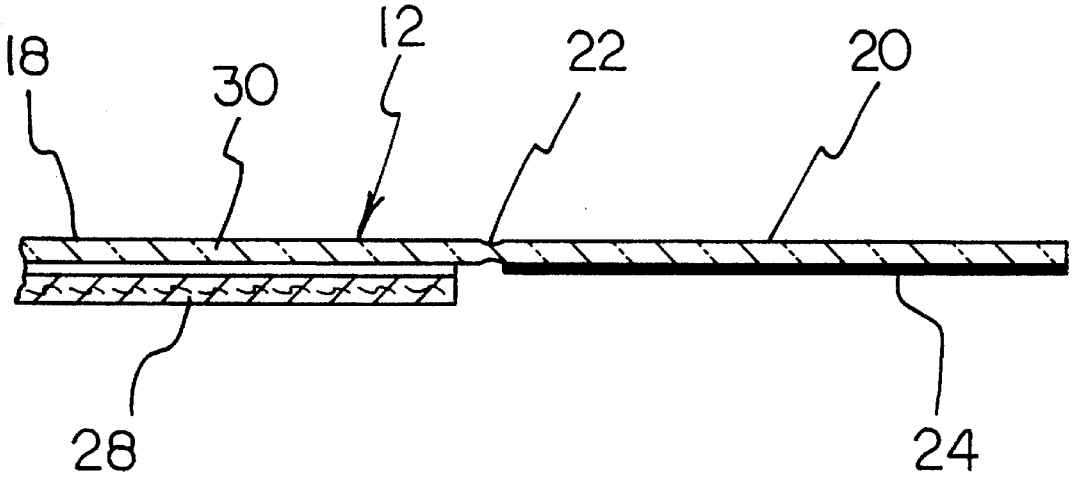
FIG. 5 is a cross sectional view taken along line 5—5 of FIG. 3.
Figure 6:
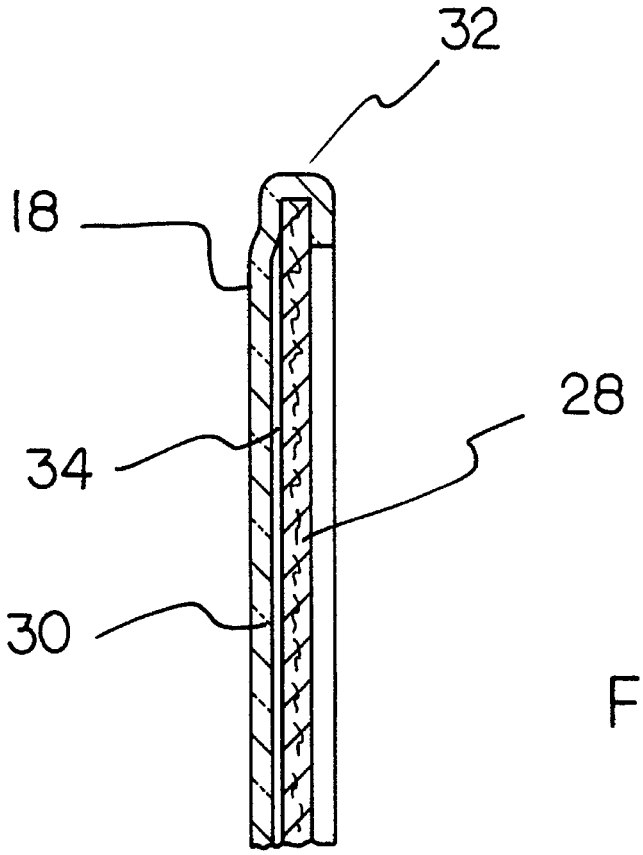
FIG. 6 is a cross sectional view taken along line 6—6 of FIG. 3.

As best illustrated in the cross sectional illustrations of the front cover means 12 presented in FIGS. 5 and 6, it can be shown that the cover envelope 18 of each of the cover means 12 and 16 comprises a substantially rectangular rigid inner panel 28 having a transparent outer panel 30 coupled along a peripheral edge thereof, as at 32 in FIG. 6. Preferably, the transparent outer panel 30 is coupled to upper and lower edges of the rigid inner panel 28, as well as to an outer edge of the rigid inner panel, with an inner edge of the rigid inner panel 28 being spaced and separated from the transparent outer panel. By this structure, a rectangular cavity 34 is defined between the rigid inner panel 28 and the transparent outer panel 30 within which the cover of the catalog 14 can be received. Preferably, and as shown in FIG. 6, the rigid inner panel 28 includes an unlabeled front face and a rear face (not labeled) with an unlabeled outer peripheral edge extending around the rigid inner panel and between the front face and the rear face thereof. The transparent outer panel 30 is coupled to the front face of the rigid inner panel 28 proximal to the outer edge and the upper and lower edges of the rigid inner panel. The transparent outer panel 30 is further coupled to and extends over the peripheral edge proximal to the outer edge and the upper and lower edges of the rigid inner panel 28, with the transparent outer panel subsequently extending onto and being coupled to the rear face of the rigid inner panel proximal to the outer edge and the upper and lower edges of the rigid inner panel, as shown.

With continuing reference to FIG. 5, it can be shown that the binding panel 20 is preferably comprised of a rectangular extension of the transparent outer panel separated therefrom by the fold line 22 extending in a substantially parallel and spaced orientation relative to the inner edge of the rigid inner panel 28. Thus, the binding panel is also transparent to permit viewing of the binding of the catalog 14 therethrough. In this respect, it is desirable that the adhesive 24 securing the binding panel 20 to the binding of the catalog 14 also be transparent or at least translucent.

Figure 7:
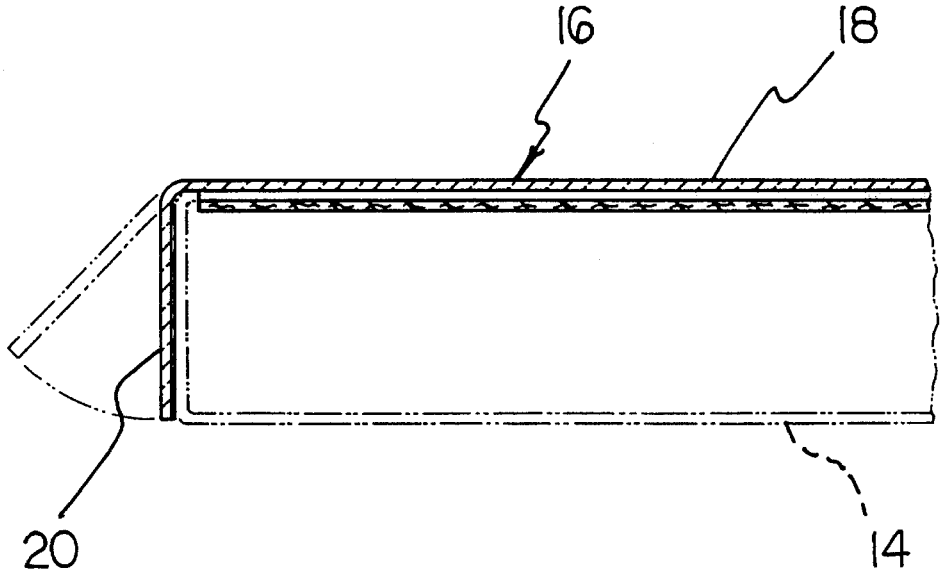
FIG. 7 is a cross sectional illustration detailing an installation of a rear cover means of the invention onto a catalog.
Figure 8:
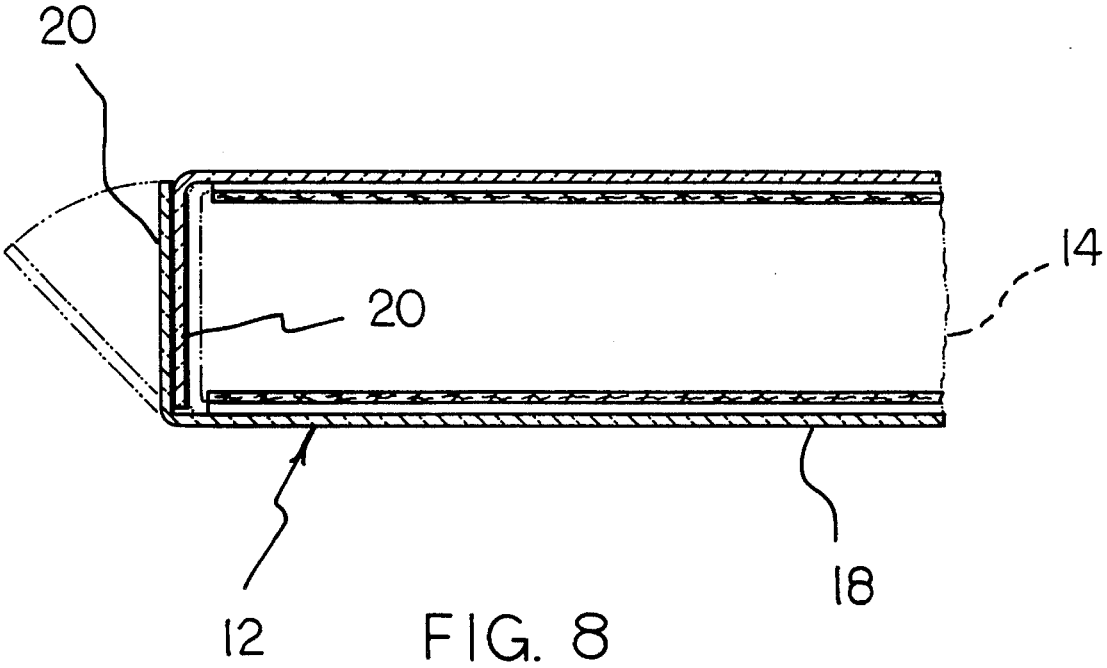
FIG. 8 is a further cross sectional illustration detailing a placement of the front cover means onto the catalog.

Referring now to FIGS. 7 and 8 wherein an installation procedure is illustrated, it can be shown that the cover envelope 18 of the rear cover means 16 can be positioned so as to receive the unlabeled rear cover of the catalog 14 therewithin. The binding panel 20 of the rear cover means 16, with the adhesive 24 thereon being exposed, can then be pivoted into an abutting engagement with the binding of the catalog 14 for adhesive attachment thereto. As shown in FIG. 8, the cover envelope 18 of the front cover means 12 can then receive the front cover of the catalog 14. The binding panel 20 of the front cover means 12 can then be adhesively attachment to an exterior of the binding panel 20 of the rear cover means 16, whereby the transparent or translucent nature of the binding panels 20 permits viewing of the binding of the catalog 14 therethrough.

In use, the periodical hardcover 10 according to the present invention can be easily coupled to a periodical such as the catalog 14 illustrated herein. The cover envelopes 18 of the front and rear cover means 12 and 16 serve to substantially protect and rigidify the cover of the periodical so as to preclude a sagging deformation thereof when the catalog is supported upon its end as illustrated in FIG. 1. Further, the binding panels 20, because of their transparent construction, permit viewing of indica or the like printed on the binding of the catalog 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A periodical hardcover comprising:

a rear cover means for adhesively securing to a binding of a periodical and for receiving and enclosing a rear cover of the periodical to permit viewing of the rear cover thereof from an exterior of the rear cover means;

and, a front cover means for adhesively coupling to the rear cover means and for receiving and enclosing a front cover of the periodical to permit viewing of the front cover thereof from an exterior of the front cover means, wherein the front cover means is substantially similar in design and configuration relative to the rear cover means, with the cover means each comprising a cover envelope means for receiving a cover of the periodical, and a binding panel means pivotally coupled to an edge of the cover envelope means for engaging a binding of the periodical, the binding panel means being integrally coupled to the cover envelope means, with a fold line extending therebetween and permitting pivoting of the binding panel means relative to the cover envelope means, an interior surface of the binding panel means being coated with an adhesive which can be utilized to secure the interior surface of the binding panel means to the binding of the periodical;

and further wherein the cover envelope means of each of the cover means comprises a substantially rectangular rigid inner panel having a transparent outer panel coupled along a peripheral edge thereof, the transparent outer panel being coupled to respectively opposed upper and lower edges of the rigid inner panel and to an outer edge of the rigid inner panel, with an inner edge of the rigid inner panel being spaced and separated from the transparent outer panel such that a rectangular cavity is defined between the rigid inner panel and the transparent outer panel within which the cover of the periodical can be received, wherein the rigid inner panel is of a first rigidity and the transparent outer panel is of a second rigidity, with the first rigidity being substantially greater than the second rigidity.

2. The periodical hardcover of claim 1, wherein the rigid inner panel is constructed of a first material and the transparent outer panel is constructed of a second material, with the first material being disparate relative to the second material.

3. The periodical hardcover of claim 2, wherein the first material of the rigid inner panel is substantially opaque.

4. The periodical hardcover of claim 3, wherein the rigid inner panel includes a front face and a rear face with an outer peripheral edge extending around the rigid inner panel and between the front face and the rear face thereof, with the transparent outer panel being coupled to the front face of the rigid inner panel proximal to the outer edge and the upper and lower edges of the rigid inner panel, the transparent outer panel being coupled to and extending over the peripheral edge proximal to the outer edge and the upper and lower edges of the rigid inner panel, with the transparent outer panel extending onto and being coupled to the rear face of the rigid inner panel proximal to the outer edge and the upper and lower edges of the rigid inner panel.

* * * * *